US009212476B2

(12) United States Patent
Mühlhausen et al.

(10) Patent No.: US 9,212,476 B2
(45) Date of Patent: Dec. 15, 2015

(54) APPLICATOR FOR GEL-LIKE TOILET BOWL-CLEANING PRODUCTS DIRECTLY ON THE SURFACE OF THE TOILET BOWL

(75) Inventors: Hans-Georg Mühlhausen, Dusseldorf (DE); Detlef Lehmann, Erkrath-Hochdahl (DE)

(73) Assignee: HENKEL AG & CO. KGAA, Dusseldorf (DE)

( * ) Notice: Subject to any disclaimer, the term of this patent is extended or adjusted under 35 U.S.C. 154(b) by 0 days.

(21) Appl. No.: 14/235,672

(22) PCT Filed: Aug. 11, 2011

(86) PCT No.: PCT/EP2011/063813

§ 371 (c)(1),
(2), (4) Date: May 21, 2014

(87) PCT Pub. No.: WO2013/020597

PCT Pub. Date: Feb. 14, 2013

(65) Prior Publication Data

US 2014/0339260 A1 Nov. 20, 2014

(51) Int. Cl.
*E03D 9/00* (2006.01)
*B65D 83/00* (2006.01)
(Continued)

(52) U.S. Cl.
CPC ..... *E03D 9/005* (2013.01); *B65D 81/325* (2013.01); *B65D 83/0005* (2013.01); *E03D 2009/026* (2013.01)

(58) Field of Classification Search
CPC ..... B65D 81/325; E03D 9/005; E03D 9/002; E03D 2009/026; E03D 2009/028
USPC ..... 222/136, 137
See application file for complete search history.

(56) References Cited

U.S. PATENT DOCUMENTS 8,814,456 B2 * 8/2014 Schultz et al. ..... 401/137
8,851,339 B2 * 10/2014 Schultz et al. ..... 222/386
(Continued)

FOREIGN PATENT DOCUMENTS

DE 102010028352 A1 11/2011
EP 2281756 A1 2/2011
(Continued)

OTHER PUBLICATIONS

JP2011/73765A machine translation, May 17, 2015, 48 pgs.*
(Continued)

*Primary Examiner* — Daniel R Shearer
(74) *Attorney, Agent, or Firm* — Ingrassia Fisher & Lorenz, P.C.

(57) ABSTRACT

An applicator for gel-form products, in particular a toilet cleaning product is provided. The applicator includes a receiving space for a first gel-form product, the receiving space comprising a first orifice and a second orifice. The first orifice releases the gel-form product and the second orifice accommodates a piston movable in the receiving space, by means of which the gel-form product may be forced through the first orifice. On the applicator, around the first orifice of the receiving space, at least three spacer elements are arranged that are configured such that, when the applicator is pressed onto a, in particular ceramic, toilet surface to which the gel-form product is to be applied, a gap A is formed between the first orifice and the surface and the gel-form product may flow freely around the spacer elements on discharge.

17 Claims, 3 Drawing Sheets

(51) Int. Cl.
*B65D 81/32* (2006.01)
*E03D 9/02* (2006.01)

(56) References Cited

U.S. PATENT DOCUMENTS

| | | | | |
|---|---|---|---|---|
| 2007/0007302 | A1* | 1/2007 | Jaichandra et al. | 222/47 |
| 2009/0215909 | A1* | 8/2009 | Wortley et al. | 514/772 |
| 2010/0155431 | A1* | 6/2010 | Bartolucci et al. | 222/389 |
| 2011/0095026 | A1* | 4/2011 | Habibi-Naini | 220/315 |

FOREIGN PATENT DOCUMENTS

| | | | | |
|---|---|---|---|---|
| EP | 2314522 | A1 | | 4/2011 |
| EP | 2361850 | A1 | | 8/2011 |
| JP | 2011073765 | A | * | 4/2011 |
| WO | 2011040581 | A1 | | 4/2011 |

OTHER PUBLICATIONS

International Search Report mailed Apr. 20, 2012 in PCT/EP2011063813.

* cited by examiner

APPLICATOR FOR GEL-LIKE TOILET BOWL-CLEANING PRODUCTS DIRECTLY ON THE SURFACE OF THE TOILET BOWL

CROSS REFERENCE TO RELATED APPLICATION

This application claims priority to International Patent Application No. PCT/EP2011/063813, filed Aug. 11, 2011, which is incorporated herein by reference in its entirety.

TECHNICAL FIELD

The technical field relates to an applicator for applying at least one gel-form product, in particular a WC cleaning product, to a surface, in particular a ceramic WC surface.

BACKGROUND

A release device for a high-viscosity, in particular gel-like, active substance preparation, in particular for domestic hygiene applications such as in a toilet bowl (water-closet or "WC") or the like, is provided herein, including a release device in which the gel-like active substance preparation is not yet located and a release device including the gel-like active substance preparation contained therein.

High-viscosity, in particular gel-like active substance preparations have long been known for cleaning and/or disinfecting and/or fragrancing in particular sanitary articles such as toilet bowls (DE 100 48 887 A1). Such high-viscosity active substance preparations are viscous gel-like to pasty active substance compositions that are applied from a corresponding container, the release device, directly onto the surface of the sanitary article and adhere there and are only rinsed off completely after a relatively large number of flushes. As a result of the direct adhesion of the active substance preparation to the surface of the sanitary article, it is not necessary to provide additional containers, or "toilet baskets", which have to remain in the sanitary article, in particular therefore the toilet bowl. Specifically, use thereof is sometimes regarded as unhygienic by the consumer in particular when replacing the product and when cleaning the toilet.

Similar problems as arise with toilet bowls also arise in other fields of application, for example in urinals, in hand basins or washbasins, in industrial washbasins, dishwashing machines etc. One particular application for release devices with such high-viscosity, in particular gel-like, active substance preparations is under the rims of toilet bowls.

To apply the high-viscosity, in particular gel-like, active substance preparation to the surface to be cleaned or flushed with flush water during flushing, a suitable applicator, i.e., a corresponding release device, is used. To this end, application methods from other fields can be used, for example release devices for pasty active substance preparations in the field of sealing and adhesive technology. In this field it is known to store the active substance preparation in a cartridge, which is provided with an application tip. The cartridge is inserted into a piston/cylinder arrangement. A feed piston contained in the cartridge with the active substance preparation and formed by the bottom thereof is forced by the feed end face of the piston of the piston/cylinder arrangement towards the application tip. In the process the active substance preparation is forced out of the application tip onto the application region.

Such a piston/cylinder arrangement, operating like a syringe, is also suitable, if correctly dimensioned, as a release device for the relevant high-viscosity, in particular gel-like, active substance preparations of this field of application (DE 100 48 887 A1; WO 02/26925 A1; DE 198 26 293 A2; WO 99/66017 A; WO 99/66021 A1). With such a "basket-less" release device for the active substance preparation for example for a toilet bowl, the single-handed actuation possible with a syringe-like design is convenient. An operator then has the other hand free, to support him- or herself for example against the wall while leaning over the toilet bowl to apply the active substance preparation in the toilet bowl.

To prevent unhygienic contact between parts of the body and the edge of the toilet bowl, a convenient dimensioning of the release device, i.e., a slender, somewhat elongated design of the receiving cylinder is convenient, in particular for underrim application.

The problem underlying the teaching is that of configuring and further developing the known release device configured as a syringe-like piston/cylinder arrangement for a high-viscosity, in particular gel-like, active substance preparation in such a way that it is improved with regard to handling and in particular with regard to the aesthetic appearance of the gel body applied to a surface.

SUMMARY

Accordingly, an applicator for gel-form products, in particular a toilet cleaning product is provided herein. The applicator has a receiving space for a first gel-form product.

The receiving space has a first orifice and a second orifice. The first orifice is provided to release the gel-form product and the second orifice is provided to accommodate a piston movable in the receiving space, by means of which the gel-form product may be forced through the first orifice. On the applicator, around the first orifice of the receiving space, there are arranged at least two, preferably at least three spacer elements which are configured such that, when the applicator is pressed onto, in particular a ceramic toilet surface to which the gel-form product is to be applied, a gap A is formed between the first orifice and the surface and the gel-form product may flow freely around the spacer elements on discharge.

The number and arrangement of the spacer elements may, by allowing the preparation(s) to flow in corresponding manner around the spacer elements, result in targeted shaping of the gel-form product to be applied. The small contact surface in the configuration according to an embodiment between applicator and application surface minimize unavoidable soiling (bacteria, microorganisms) of the applicator or of the gel-form product during the application process.

Creation of a gap A between the first orifice of a receiving space and the surface for application and the arrangement of spacers around the first orifice ensures that the area of product contact with the surface is greater than the product outlet area from the first orifice. The resultant different levels of adhesive force when withdrawing the applicator from the relevant surface ensure the gel-form product is torn off easily and cleanly from the applicator.

Because the spacer elements define the flow of a gel-form preparation only in places on application thereof, owing to the gel-form preparation being able to flow around the spacer elements, dispensing appropriate to the circumstances is also made possible, such that a greater or lesser quantity of gel-form preparation may be dispensed by the user for example depending on the desired cleaning performance of the gel-form product within a toilet bowl.

Use of the spacer elements according to an embodiment around which preparation may flow thus also makes it possible in particular to apply a dispensing amount differing from a single dispensing amount, in particular a double dispensing amount, to a toilet bowl. It is thus in particular also feasible for the applicator to be configured in such a way that flow around the spacer elements only occurs from a double dispensing amount, such that the user can identify from the geometry of the applied gel body whether a single, double or indeed multiple dispensing amount has been released. In addition, in such a configuration of the applicator it is likewise possible for a user to detect multiple dispensing during the application process when the applied gel begins to flow around the spacer elements and thus to protrude from the projection of the applicator contour.

It is preferred for at least one second receiving space to be provided for a second gel-form product, the first and the second gel-form products differing from one another and the second receiving space in each case comprising a first orifice and a second orifice. This makes it possible in particular to store preparations which are not stable when stored together and to apply them to a surface.

In this connection it is additionally preferable for the receiving spaces to be arranged adjacent one another. It goes without saying that it is also feasible for the receiving spaces to be arranged coaxially to one another as cylinders nested one inside the other.

To provide good demoldability from an injection mold and a minimal surface wettable by preparation during the application process, it is advantageous for the spacer elements to be of rod-shaped, in particular cylindrical construction. The cross-section of the rod-shaped spacer elements may for example however also be square, rectangular, oval, triangular, cross-shaped or star-shaped.

To ensure good product tear-off and satisfactory adhesion of the preparation to the surface, in an embodiment, the spacer elements are configured such that, when the applicator is pressed onto a surface to which the gel-form products are to be applied, a gap is formed between the first orifices of the receiving spaces and the relevant surface of about 0.5 mm—about 30 mm, preferably about 2 mm—about 10 mm.

A particularly preferable, cloud-like gel body may be applied to a surface if six spacer elements are arranged on an applicator with two receiving spaces, the spacer elements being arranged in such a way that each of the first orifices of the receiving spaces is surrounded by four spacer elements.

In a preferred embodiment, the spacer elements are arranged on an adapter which may be fixed form-fittingly and/or frictionally detachably or nondetachably to the applicator. This makes it possible to offer differently positioned spacer elements, which in each case bring about different shaping of the gel-form products on the surface to which they are to be applied, such that a user may for example select a preferred shape.

Finally it is recommended to use the applicator according to an embodiment in conjunction with special active substance preparations in order to achieve the correct application. To this end, provision is made for the active substance preparation to take the form of a cleaning agent preparation, in particular a cleaning agent preparation suitable for sanitary purposes, in particular mixed with a scent component, in particular an active substance preparation according to DE 100 48 887 A1 and/or WO 02/26925 A1 and/or DE 198 26 293 A1 and/or WO 99/66017 A1 and/or WO 99/66021 A1. The content thereof is included by reference herein.

The applicator according to an embodiment is suitable for applying gel-form preparations to surfaces. In particular, the applicator is suitable for applying a toilet cleaning preparation to a ceramic toilet surface. In addition, the applicator according to an embodiment may be used to apply gel-form preparations such as for example textile washing agents and/or washing auxiliaries to a surface, such as for example the inside of a washing machine door or in a dispensing compartment of a dispensing drawer of a washing machine. It is additionally feasible for a dishwashing preparation to be applied by means of the applicator according to an embodiment for example to the inside of a dishwashing machine door, into the dispensing chamber of a dishwashing machine or the like.

It is particularly preferable to use the applicator according to an embodiment with gel-form preparations from the group of cleaning preparations, scent preparations, washing agent preparations, rinsing agent preparations or insecticide preparations.

The following combinations are examples of different gel-form preparations which may be used with a two-chamber applicator:

| Field of application | Chamber 1 | Chamber 2 |
|---|---|---|
| Toilet cleaning product | Bleach-containing preparation | Scent-containing preparation |
| Toilet cleaning product | Chlorine-containing preparation | Scent-containing preparation |
| Textile washing agent | Enzyme-containing preparation | Bleach-containing preparation |
| Textile washing agent | Washing agent preparation | Conditioner preparation |
| Automatic dishwashing agent | Enzyme-containing preparation | Bleach-containing preparation |

It is moreover possible for the gels dispensed from the different chambers in particular to exhibit differing water solubility, such that for example time-offset release may proceed from the gels applied in this way.

BRIEF DESCRIPTION OF THE DRAWINGS

The invention is illustrated in greater detail below with reference to drawings which represent a merely exemplary embodiment. In the drawings.

DETAILED DESCRIPTION

Figure 1:
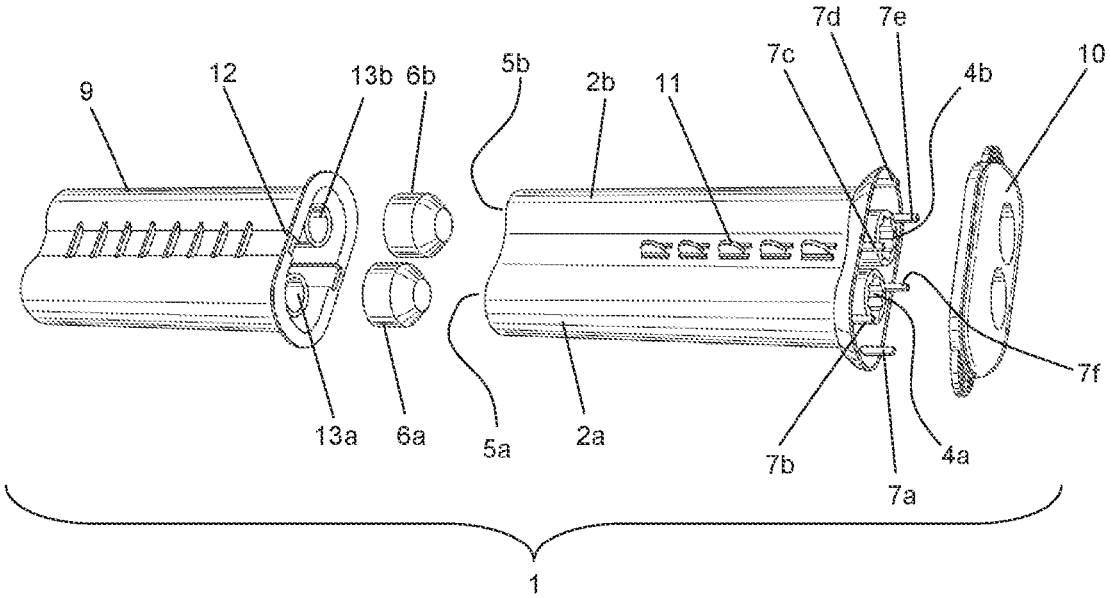
FIG. 1 is an exploded representation of a two-chamber applicator according to an exemplary embodiment.

FIG. 1 is a perspective exploded view of an applicator 1 according to an exemplary embodiment. In the exemplary embodiment shown, the applicator 1 is provided with two receiving spaces 2*a*, 2*b* for different gel-form preparations 3*a*, 3*b* (not shown). This embodiment is also described as a two-chamber applicator. The two receiving spaces 2*a*, 2*b* are arranged adjacent one another and are joined together to form a single part by way of a web.

The cylindrically shaped receiving spaces 2*a*, 2*b* each comprise first substantially circular orifices 4*a*, 4*b* and second circular orifices 5*a*, 5*b*, the first orifices 4*a*, 4*b* being provided to release the gel-form products 3*a*, 3*b* and the second orifices 5*a*, 5*b* being provided to accommodate pistons 6*a*, 6*b* movable in their respective receiving spaces 2*a*, 2*b*, by means of which pistons the gel-form products 3*a*, 3*b* may be forced through the first orifices 4*a*, 4*b*.

On the applicator 1, around the first orifices 4*a*, 4*b* of the receiving spaces 2*a*, 2*b*, there are located a total of 6 spacer elements 7*a*, 7*b*, 7*c*, 7*d*, 7*e*, 7*f* in the form of cylindrical rods, which extend parallel to the direction of flow of the preparations 3*a*, 3*b* out of the plane of the orifices 4*a*, 4*b*, such that, when the applicator 1 is pressed onto an, in particular ceramic, toilet surface 8 to which the gel-form product 3*a*, 3*b* is to be applied, a gap A is formed between the orifices 4*a*, 4*b* and the surface 8 and the gel-form products 3*a*, 3*b* may flow freely around the spacer elements 7*a*, 7*b*, 7*c*, 7*d*, 7*e*, 7*f* on discharge. This is also clearly visible in FIG. 2.

The orifices 4*a*, 4*b* may be closed using the closing cap 10 and thus protected against desiccation of the gel-form preparations 3*a*, 3*b*.

The pistons 6*a*, 6*b* movable in the receiving spaces 2*a*, 2*b* are connected to a piston receptacle 9. The pistons 6*a*, 6*b* are each positioned on cylindrical receiving elements 13*a*, 13*b*, which extend inside the piston receptacle 9. Providing a piston receptacle 9 for each piston 6*a*, 6*b* ensures that the same quantity ratios of gel-form products 3*a*, 3*b* are released from the orifices 4*a*, 4*b* on advance of the piston receptacle 9.

The piston receptacle 9 is configured such that the receiving elements 13*a*, 13*b* engage with the pistons 6*a*, 6*b* in the corresponding receiving spaces 2*a*, 2*b* and the outer jacket of the piston receptacle 9 encloses the outside of the receiving spaces 2*a*, 2*b*. This ensures good guidance of the piston receptacle 9 relative to the receiving spaces 2*a*, 2*b* on advance.

Furthermore, the piston receptacle 9 comprises a peripheral collar 12, the function of which is explained below.

The applicator 1 comprises resilient, outwardly projecting portion markers 11 arranged between the two receiving spaces 2*a*, 2*b* parallel to the direction of flow of the preparations 3*a*, 3*b*, said portion markers impacting against the collar 12 of the piston receptacle 9 on advance of the piston receptacle 9. The portion markers 11 are ramp-shaped or arcuate in form in the direction of advance of the piston receptacle 9.

The portion markers 11 exhibit limited intrinsic mobility due to transverse slots which are configured such that they form resilient tongues in the plastics material. In the exemplary embodiment shown, this is utilized for a further measure, namely for assigning resistances to the individual portion markers 11 on advance of the piston receptacle 9 in the direction of the orifices 4*a*, 4*b*. When the piston receptacle 9 is pushed into the receiving spaces 2*a*, 2*b*, a slight resistance is therefore felt when the respective position marker 11 is reached. By mounting the portion markers 11 resiliently, the portion marker 11 is pressed by the collar 12 of the piston receptacle 9 against the spring resilience into the interior of one of the receiving spaces 2*a*, 2*b*. The user therefore does not have to look at the applicator 1 during application of the active substance preparation, but rather may simply feel as the piston receptacle 9 is pushed in whether a portion has been completely applied.

It goes without saying that a person skilled in the art may also use any other suitable type of latching and means for portioned release of the gels for the applicator disclosed.

Figure 2:
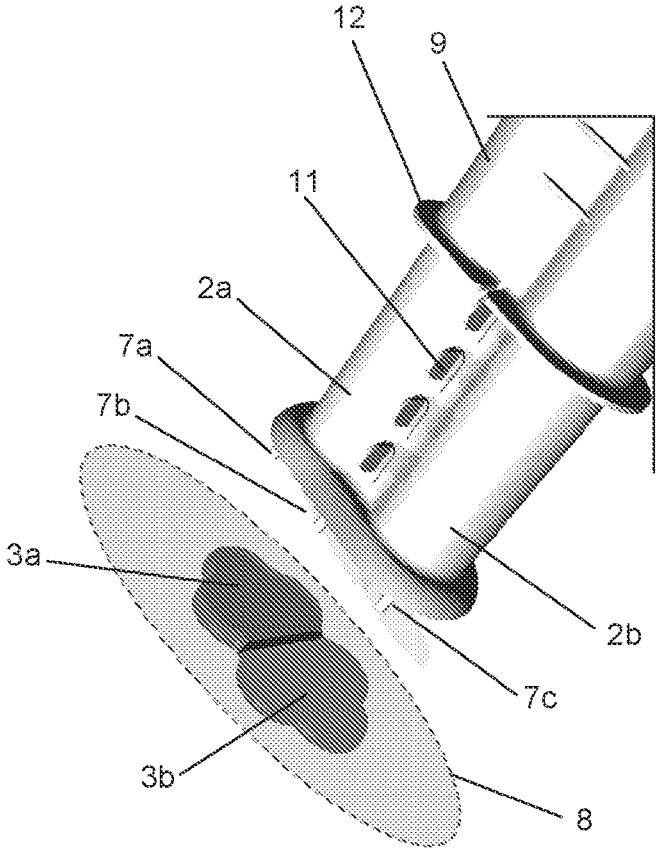
FIG. 2 shows a ceramic surface and a two-chamber applicator according to an exemplary embodiment after application of the gel-form preparations.

The mode of operation of the two-chamber applicator known from FIG. 1 is further explained with reference to FIG. 2. FIG. 2 shows a ceramic surface 8 and a two-chamber applicator 1 after application of the gel-form preparations 3*a*, 3*b* to the surface 8.

The two-chamber applicator 1 has been placed onto the surface 8, such that the spacer elements 7 contact the surface 8. As a consequence, a gap A is formed between the orifices 4*a*, 4*b* and the surface 8. The gel-form preparations 3*a*, 3*b* were then applied through advance of the piston receptacle 9 in the direction of the orifices 4*a*, 4*b* out of the applicator 1 onto the surface 8. The preparations 3*a*, 3*b* then flowed freely around the spacer elements 7, such that, as a result, gel adheres to the surface for instance in the shape of a cloud, as shown in FIG. 2.

Figure 3:
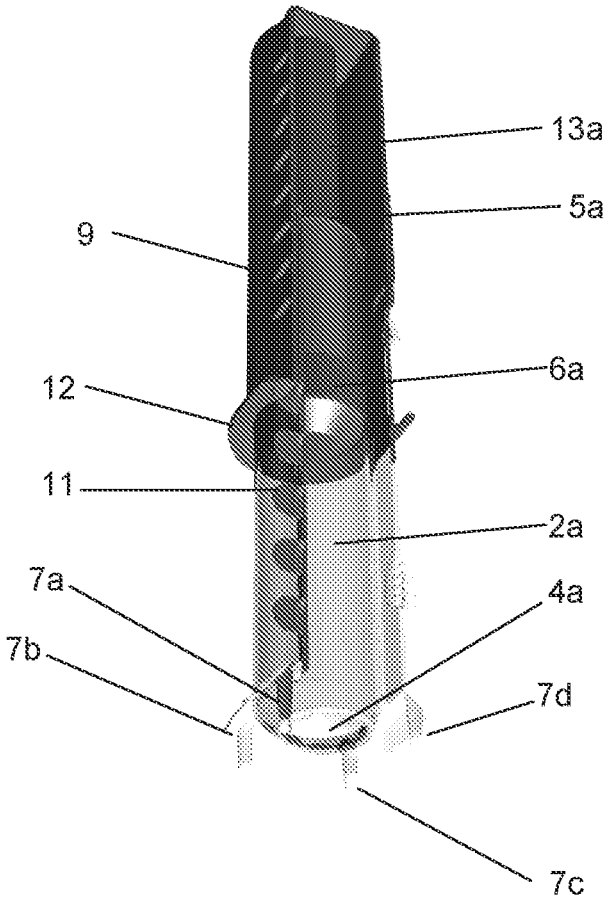
FIG. 3 is a perspective longitudinal section through an applicator according to an exemplary embodiment.

FIG. 3 shows a perspective longitudinal section through a chamber of the two-chamber applicator known from FIGS. 1-2.

It may be seen that the piston 6*a* is arranged inside the cylindrical receiving space 2*a* so as to be movable through the orifice 5*a*. The piston 6*a* is embodied in such a way as to be leakproof relative to the receiving space 2*a*. To this end, the piston 6*a* may for example be formed of a resilient and/or conformable material, such as for instance an elastomer. The piston 6*a* has been placed on the receiving element 13*a* of the piston receptacle 9. The outer jacket of the piston receptacle 9 encloses the receiving space 2*a*.

On advance of the piston receptacle 9 to release preparation from the applicator 1, the collar 12 is moved against the resiliently mounted position markers 11. As a result of the ramp-shaped or arcuate configuration thereof, the position markers 11 are forced by the advance of the piston receptacle 9 into the interior of the receiving space 2*a*. The user here feels a resistance, which shows him or her that a portion of preparation has been released. By further advance it is also possible to release a plurality of portions of preparation from the applicator 1.

Figure 4:
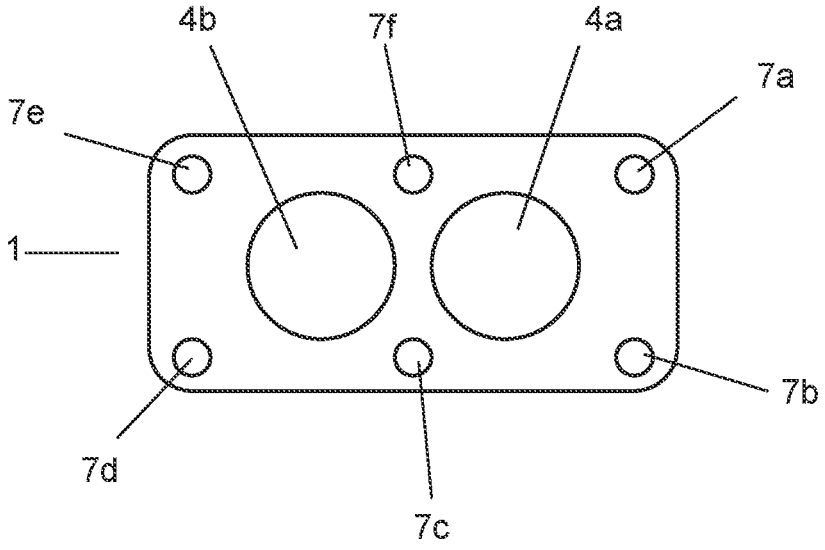
FIG. 4 shows an arrangement of six spacer elements relative to the release orifices of a two-chamber applicator according to an exemplary embodiment.

FIG. 4 shows a preferred arrangement of 6 spacer elements 7*a*-*f* relative to the release orifices 4*a*, 4*b* of a two-chamber applicator. The release orifices 4*a*, 4*b* are each surrounded by four spacer elements, the arrangement of the 4 spacer elements surrounding each release orifice defining a square or rectangular surface area within which one of the release orifices 4*a*, 4*b* is arranged.

Such a configuration is capable of producing cloud-like gel adhesions on a surface.

Figure 5:
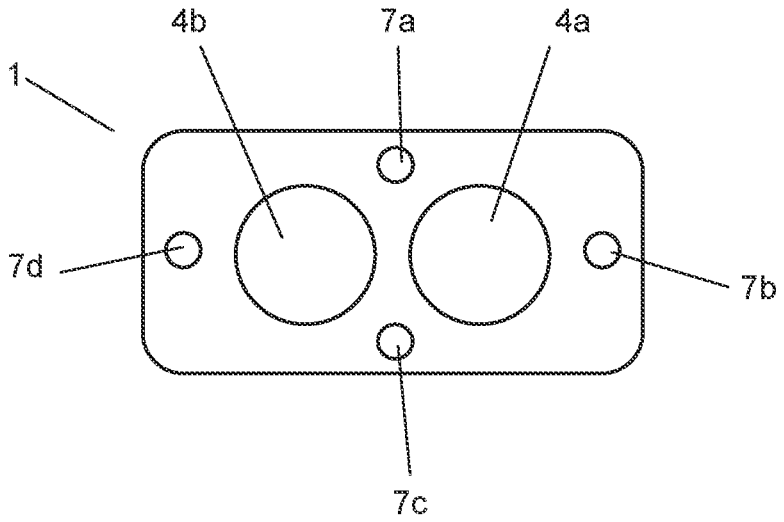
FIG. 5 shows an arrangement of four spacer elements relative to the release orifices of a two-chamber applicator according to an exemplary embodiment.
Figure 6:
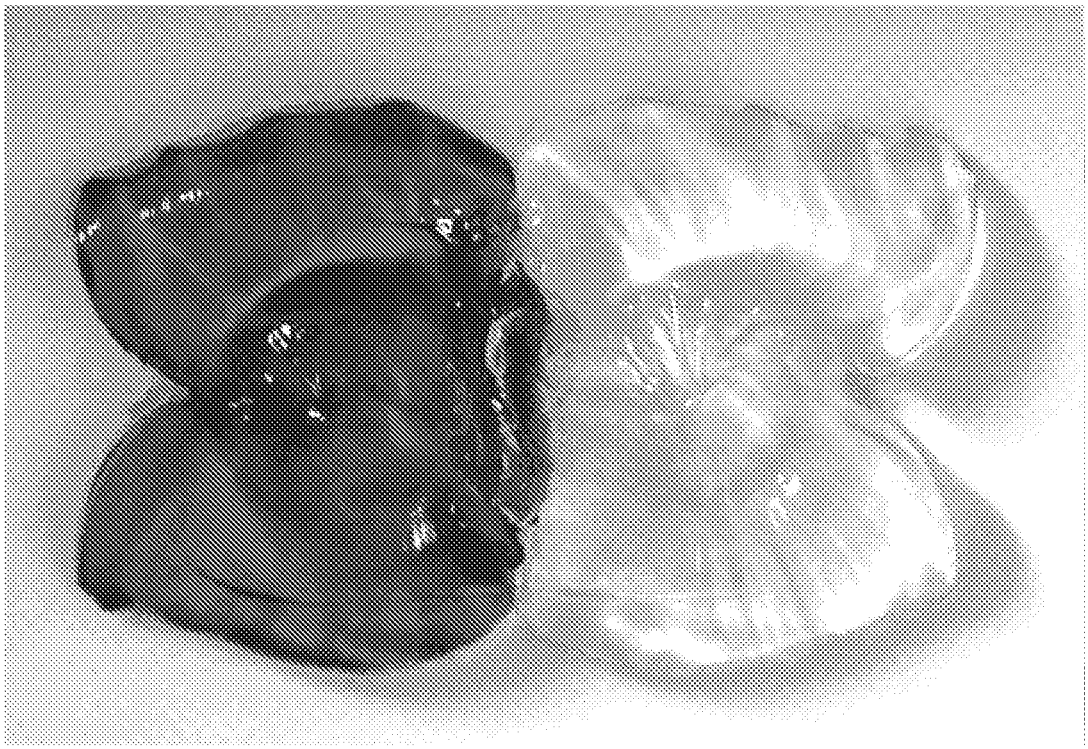
FIG. 6 shows gel bodies produced with an applicator of FIG. 5.

FIG. 5 shows a possible arrangement of four spacer elements relative to the release orifices of a two-chamber applicator. The spacer elements 7*a*-*d* lie opposite one another in pairs (7*a*-7*c*; 7*b*-7*d*), their connecting lines forming a cross, whose point of intersection lies approximately centrally between the release orifices 4*a*, 4*b*. The butterfly-like gel body produced with this configuration of spacer elements 7*a*-*d* is reproduced in FIG. 6.

The invention claimed is:

1. An applicator for gel-form products comprising:

a first receiving space for a first gel-form product, the first receiving space comprising a first orifice and a second orifice, the first orifice being provided to release the first gel-form product and the second orifice being provided to accommodate a piston movable in the first receiving space, by means of which the first gel-form product may be forced through the first orifice;

a piston receptacle provided for the piston, the piston receptacle configured such that it encloses the outside of the first receiving space at least in places;

resilient, outwardly-projecting portion markers, said resilient, outwardly-projecting portion markers impacting against a collar of the piston receptacle on advance of the piston receptacle; and at least two spacer elements on the applicator arranged around the first orifice of the first receiving space, wherein the at least two spacer elements are configured such that, when the applicator is pressed onto a surface to which the first gel-form product is to be applied, a gap A is formed between the first orifice and the surface and, when the piston receptacle is advanced from a first portion marker to an adjacent second portion marker of the resilient, outwardly-projecting portion markers, a quantity of the first gel-form product is discharged and flows freely around the at least two spacer elements.

2. The applicator according to claim 1, wherein a second receiving space is provided for a second gel-form product, the first and the second gel-form products differing from one another and the second receiving space in each case comprising a first orifice and a second orifice.

3. The applicator according to claim 2, wherein the first and the second receiving spaces are arranged adjacent one another.

4. The applicator according to claim 3, wherein the first and the second receiving spaces are connected together by way of at least one web.

5. The applicator according to claim 1, wherein the at least two spacer elements are rod-shaped.

6. The applicator according to claim 1, wherein the at least two spacer elements are configured such that, when the applicator is pressed onto the surface to which the gel-form products are to be applied, a gap is formed between the first orifice of the first receiving space and the surface of about 0.5 mm to about 30 mm.

7. The applicator according to claim 2, wherein the at least two spacer elements comprise six spacer elements that are arranged on the applicator, the six spacer elements being arranged in such a way that each of the first orifices of the first and the second receiving spaces is surrounded by four spacer elements.

8. The applicator according to claim 1, wherein the at least two spacer elements are arranged on an adapter which is fixed form-fittingly and/or frictionally detachably or nondetachably to the applicator.

9. The applicator according to claim 1, wherein the at least two spacer elements may be connected form-fittingly or frictionally detachably or nondetachably with the applicator.

10. The applicator according to claim 1, wherein the at least two spacer elements are formed in a single part with the applicator.

11. The applicator according to claim 2, wherein the piston receptacle is provided for at least two pistons, the piston receptacle configured such that it encloses the outside of the first and the second receiving spaces at least in places.

12. The applicator according to claim 11, wherein the second receiving space or both the first receiving space and the second receiving space comprises resilient, outwardly-projecting portion markers, said resilient, outwardly-projecting portion markers impacting against the collar of the piston receptacle on advance of the piston receptacle.

13. The applicator according to claim 12, wherein the resilient, outwardly projecting portion markers are ramp-shaped or arcuate in the direction of advance of the piston receptacle.

14. The applicator according to claim 1, wherein the gel-form product is a toilet cleaning product.

15. The applicator according to claim 1, wherein the at least two spacer elements are at least three spacer elements.

16. The applicator of claim 5, wherein the at least two spacer elements are of cylindrical construction.

17. The applicator of claim 6, wherein the at least two spacer elements are configured such that, when the applicator is pressed onto the surface to which the gel-form products are to be applied, a gap is formed between the first orifice of the first receiving space and the surface of about 2 mm to about 10 mm.

* * * * *